US009561937B2

(12) United States Patent
Albu et al.

(10) Patent No.: US 9,561,937 B2
(45) Date of Patent: Feb. 7, 2017

(54) COUNTERWEIGHT ARRANGEMENT FOR AN ELEVATOR AND AN ELEVATOR

(71) Applicant: KONE Corporation, Helsinki (FI)

(72) Inventors: Razvan Albu, Vantaa (FI); Erno Lehikoinen, Saukkola (FI); Niko Forsström, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 387 days.

(21) Appl. No.: 14/193,986

(22) Filed: Feb. 28, 2014

(65) Prior Publication Data

US 2014/0284148 A1 Sep. 25, 2014

(30) Foreign Application Priority Data

Mar. 19, 2013 (EP) ..... 13159939

(51) Int. Cl.
*B66B 17/12* (2006.01)
*B66B 11/08* (2006.01)

(52) U.S. Cl.
CPC ..... *B66B 17/12* (2013.01)

(58) Field of Classification Search
CPC ..... B66B 17/12; B66B 11/08; B66B 11/008
USPC ..... 187/266, 404
See application file for complete search history.

(56) References Cited

U.S. PATENT DOCUMENTS 5,957,243 A * 9/1999 Root ..... B66B 11/00 187/266
6,722,475 B2 * 4/2004 Miller ..... B66B 11/02 187/266
7,077,241 B1 * 7/2006 Liebetrau ..... B66B 11/008 187/251
7,261,184 B2 * 8/2007 Bass ..... B66B 7/022 187/242
7,410,032 B2 * 8/2008 Kolb ..... B66B 11/02 187/252
7,882,936 B2 * 2/2011 Murao ..... B66B 11/0206 187/266
2004/0182651 A1 * 9/2004 Ishii ..... B66B 11/008 187/277
2009/0071760 A1 * 3/2009 Izumi ..... B66B 11/008 187/254

FOREIGN PATENT DOCUMENTS

CN 202156856 U 3/2012
CN 202296743 U 7/2012
WO WO 2011/135648 A1 11/2011

* cited by examiner

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

A counterweight arrangement for an elevator, includes a first vertical guide rail and a second vertical guide rail, the guide rails defining a vertical guide rail plane, a counterweight arranged to travel between the guide rails guided by the guide rails, the counterweight including a frame, which includes a first upright beam and a second upright beam and a cross beam connecting the upper ends of the upright beams, and a diverting pulley mounted between the guide rails on the cross beam of the counterweight frame, the pulley having a vertical plane of rotation, which crosses the guide rail plane. The cross beam is aligned parallel with the plane of rotation of the pulley. An elevator includes the aforementioned counterweight arrangement.

20 Claims, 4 Drawing Sheets

COUNTERWEIGHT ARRANGEMENT FOR AN ELEVATOR AND AN ELEVATOR

FIELD OF THE INVENTION

The invention relates to an elevator and its counterweight arrangement. The elevator is in particular of the type meant for transporting passengers and/or goods.

BACKGROUND OF THE INVENTION

Conventional elevators have a counterweight and an elevator car each traveling vertically guided along two guide rails. The counterweight guide rails extend typically vertically on opposite sides of the counterweight. The plane on which the two guide rails of the counterweight are positioned is called the guide rail plane of the counterweight. The elevator car is typically connected to a counterweight with a suspension roping. This roping may be connected to the counterweight either by fixing an end of the roping to the counterweight or by guiding the roping around one or more pulleys mounted on the counterweight. In the latter case, the pulley is mounted on upper part of the counterweight frame, for instance on the cross beam. In that case, the pulley has been mounted via a pulley frame which is fixed on the cross beam that connects the side structures of the counterweight frame. In some cases, the roping must be guided to pass to and from the counterweight pulley on a route that requires the pulley positioned such that its plane of rotation is an acute angle (e.g. between 5-20 degrees) relative to the guide rail plane. This may be needed because of numerous various reasons. Often this is needed to achieve good space efficiency. For instance, the roping may need to pass adequately far apart from other elevator components. Also, it may be necessary to guide the ropes in this way so as to suspend the elevator car in a particular way. A problem in known arrangements has been that the shape of the cross beam has been complicated and due to the angle between the rotation plane and the cross structure additional stiffeners have been necessary. Both the shape and number of parts adds to the cost of the product. Also, the complicated structure has made it difficult to get access to the pulley for maintenance. Additionally, it has been noticed that the different alignment of the cross beam of the frame and the pulley has causes that the frame tends to twist around a vertical axis and lean excessively on the guide rails via its guide members, such as the guide rollers or the guide sliders. This twist has the drawback that it increases the noise level and wear of the guide members.

BRIEF DESCRIPTION OF THE INVENTION

The object of the invention is, inter alia, to solve one or more of the previously described drawbacks of known solutions and problems discussed later in the description of the invention. An object of the invention is, in particular, to provide an elevator and a counterweight arrangement thereof, which is simple in structure and less prone to twisting of the counterweight.

It is brought forward a new counterweight arrangement for an elevator, comprising a first vertical guide rail and a second vertical guide rail, said guide rails defining a vertical guide rail plane of the counterweight, a counterweight arranged to travel between the guide rails guided by said guide rails, the counterweight comprising a frame, which comprises a first upright beam and a second upright beam and a cross beam connecting the upper ends of the upright beams, and a diverting pulley mounted between the guide rails on the cross beam of the counterweight frame, the pulley having a vertical plane of rotation, which crosses the guide rail plane. The cross beam is aligned parallel with the plane of rotation of the pulley. With this kind of arrangement, a roping can be arranged to arrive and leave the pulley of the counterweight along a path that can be freely chosen irrespective of the guide rail plane. Therefore, the roping can be arranged to pass a path that is optimal for the elevator suspension or otherwise advantageous, for example so as to circumvent other elevator components. The cross beam being aligned parallel with the plane of rotation of the pulley reduces the twist of the counterweight frame. Thus, the counterweight behaves stably even though said planes cross each other. Said advantages are most clearly present when the angle of said crossing is less than thirty degrees.

In a preferred embodiment, the first upright beam extends vertically adjacent the first guide rail, and the second upright beam extends vertically adjacent the second guide rail.

In a preferred embodiment, the counterweight comprises a first guide means mounted on the frame, and supported laterally against the first guide rail, and a second guide means mounted on the frame, and supported laterally against the second guide rail.

In a preferred embodiment, each guide means comprises a guide member on both the first side and the second side of the guide rail plane, and the first guide rail comprises a guide flange extending between guide members of the first guide means and the second guide rail comprises a guide flange extending between the guide members of the second guide means. This facilitates a reliable and simple guidance of the counterweight. Preferably, the guide rails are T-shaped in cross-section.

In a preferred embodiment, the first guide means is mounted on the first upright beam and the second guide means is mounted on the second upright beam. Thus, the number and location of the guide means in vertical direction can be chosen freely. Also, in this way the structure is simple, compact and rigid.

In a preferred embodiment, the aforementioned cross beam, in particular the distal ends thereof, is fixed to the upper ends of the uprights. Thus, a simple and rigid structure is achieved which can be supported stably via the cross beam. Also, a free space is formed below the cross structure which can accommodate the weight elements of the counterweight.

In a preferred embodiment, the cross beam comprises a vertically planar first side plate and a vertically planar second side plate, the side plates being parallel with the plane of rotation of the pulley and displaced from each other in the direction of the rotational axis of the pulley. This kind of box-like structure facilitates the rigidity of the overall structure. The side plates are preferably fixed to the upper ends of the upright beams.

In a preferred embodiment, the diverting pulley is placed between the side plates. In this way, an overlapped structure is achieved and the structure is space efficient. Preferably, the pulley comprises a shaft which is supported on the first side of the pulley by the first side plate and on the second side by the second side plate. Thus, the mounting of the pulley on the beam is simple in structure. Preferably, each of the plates comprises a slot which opens downwards and an end of the shaft is placed in each slot. The shaft can thus be installed from below the cross beam. Furthermore, this structure makes the engagement of the pulley shaft reliable.

In a preferred embodiment, the counterweight further comprises weight element(s) mounted on the frame. This makes the mass of the counterweight adjustable suitable for the elevator in question. Preferably, the upright beams are vertical u-profile beams their open sides facing towards each other. Preferably, the weight element(s) each have a first distal end form-locked in the channel of the first upright beam and a second distal end form-locked in channel of the second upright beam. This kind of structure is simple and reliably locks the weight elements without great number of fixing means.

Preferably, the weight elements are located between the guide rails, each weight elements having opposite side faces parallel with the guide rail plane and/or the weight elements form together a stack of weight elements with opposite side faces parallel with the guide rail plane. Thus, the weight elements are not at an angle relative to the guide rail plane. The weight elements are this way space-efficiently positioned in cross direction. The counterweight can then fit to a tight space between elevator car and shaft wall which are parallel to the guide rail plane. Furthermore, this makes it easier to position the mass center of the counterweight on or close to the guide rail plane which also facilitates reduction of the twist of the counterweight.

In a preferred embodiment, the counterweight further comprises a second cross beam connecting the lower ends of the uprights, the second cross beam being preferably aligned parallel with the plane of rotation of the pulley.

In a preferred embodiment, the center line of the first upright beam extends vertically on the first side of the guide rail plane, and the center line of the second upright beam extends vertically on the second side of the guide rail plane.

Preferably, the upright beams are vertical u-profile beams their open sides facing towards each other. Preferably, the cross beam is fixed on the inner surface of each u-profile beam. Preferably, the beams have each a planar bottom section the plane of which is orthogonal to the plane of rotation. Preferably, the beams have each edge sections extending parallel to the plane of rotation. Preferably, the first upright is displaced in the axial direction of the pulley towards one direction and the second upright is displaced in the axial direction of the pulley towards the other direction.

It is also brought forward a new elevator comprising an elevator car and a counterweight arrangement, and a roping suspending the counterweight and the elevator car, and passing around the diverting pulley. The counterweight arrangement is as defined in any one of the preceding claims.

The elevator as described anywhere above is preferably, but not necessarily, installed inside a building. The elevator is preferably of the type where the car is arranged to serve two or more landings. Then, the car preferably responds to calls from landing and/or destination commands from inside the car so as to serve persons on the landing(s) and/or inside the elevator car. Preferably, the car has an interior space suitable for receiving a passenger or passengers. The car may be provided with a floor, a ceiling, walls and at least one door these all forming together a closable and openable interior space. In this way, it is particularly well suitable for serving passengers.

BRIEF DESCRIPTION OF THE DRAWINGS

In the following, the present invention will be described in more detail by way of example and with reference to the attached drawings, in which.

DETAILED DESCRIPTION

Figure 1:
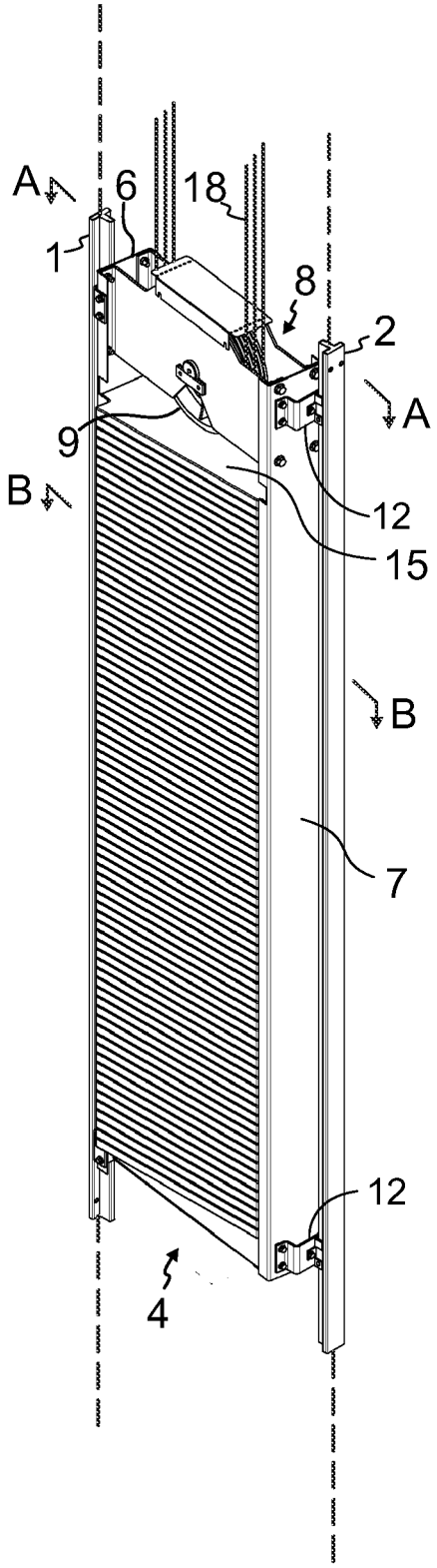
FIG. 1 illustrates a counterweight arrangement according to a preferred embodiment.
Figure 2A:
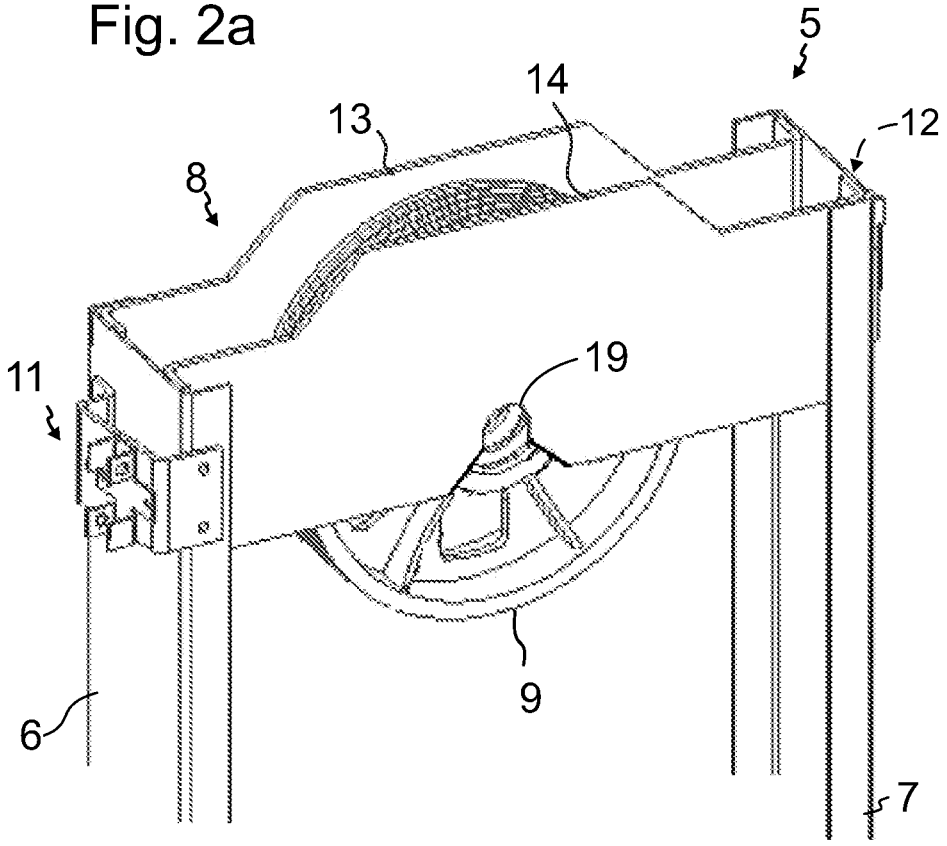
FIG. 2*a* illustrates the structure of the frame of the counterweight.
Figure 2B:
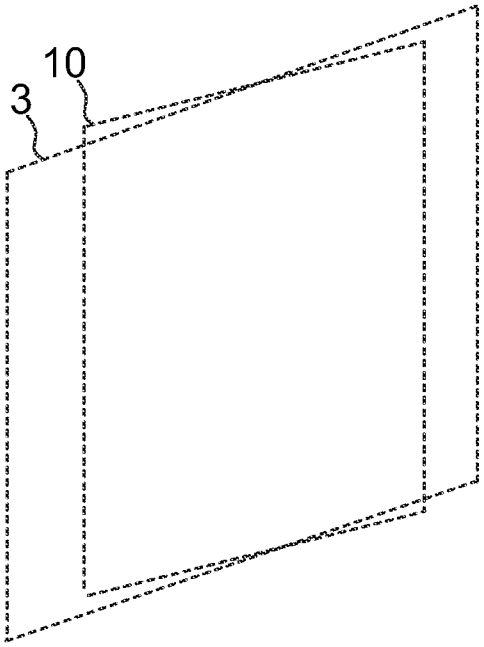
FIG. 2*b* illustrates the crossing of the plane of rotation of the pulley and the guide rail plane.
Figure 3A:
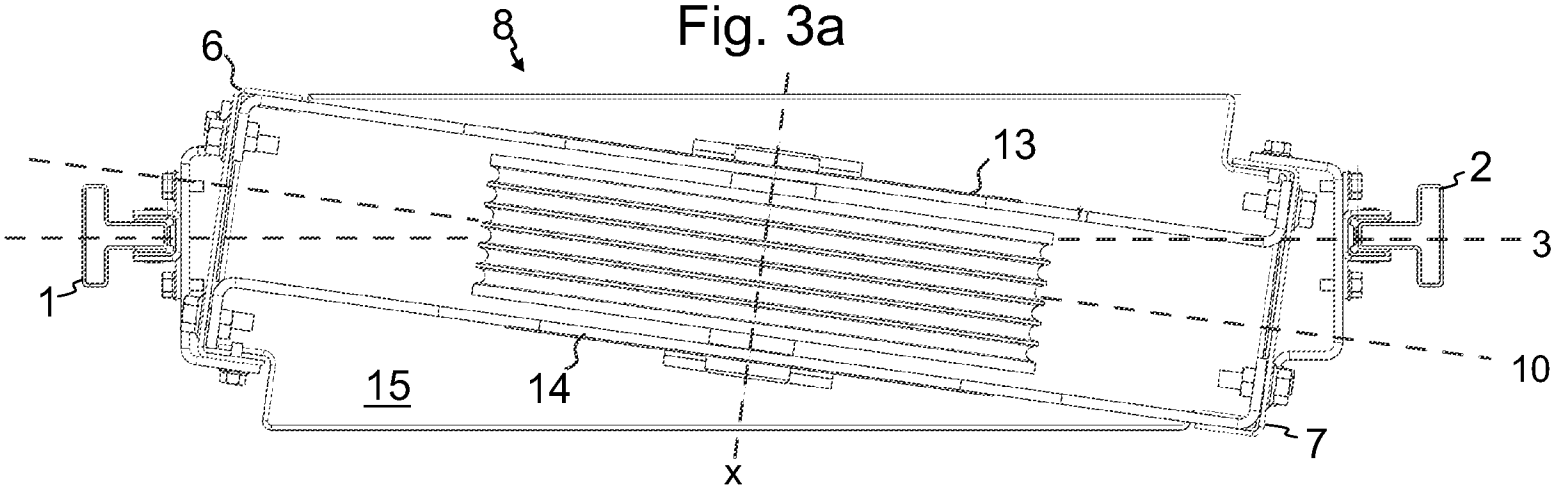
FIG. 3*a* illustrates section A-A in FIG. 1.
Figure 3B:
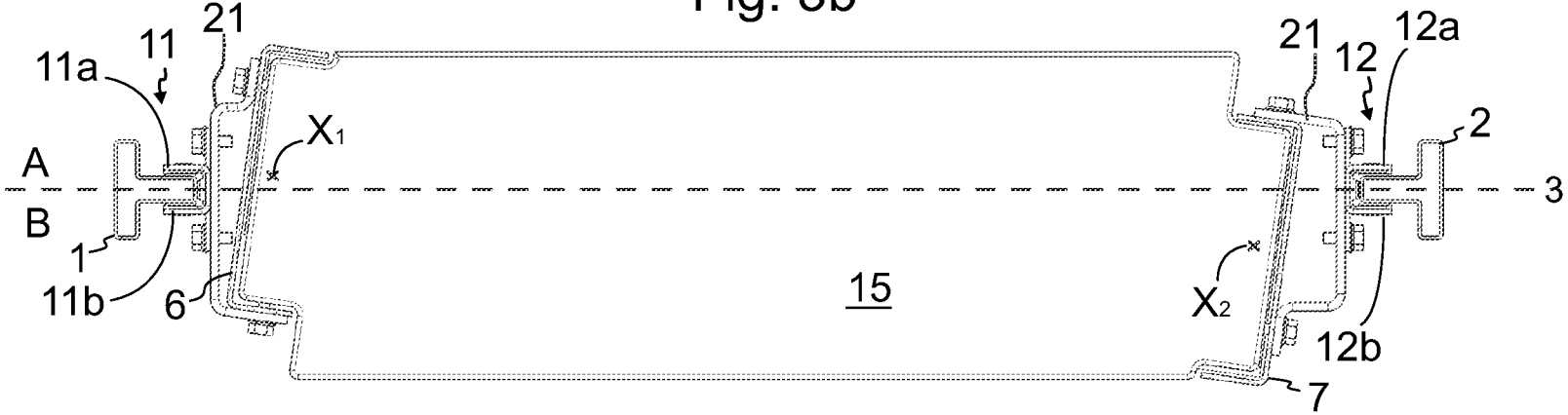
FIG. 3*b* illustrates section B-B in FIG. 1.

FIG. 1 illustrates a counterweight arrangement according to a preferred embodiment, which arrangement comprises a first vertical guide rail 1 and a second vertical guide rail 2. Only a short section of the guide rails is illustrated. The guide rails 1 and 2 continue along the dashed line. FIGS. 2, 3*a* and 3*b* illustrate the details of the arrangement. Said guide rails 1,2 define a vertical guide rail plane 3, as showed in FIGS. 3*a* and 3*b*. In other words, the guide rail plane 3 is the vertical plane on which the vertical guide rails are positioned. The arrangement comprises a counterweight 4 arranged to travel between the guide rails 1, 2 guided by the guide rails 1, 2. The counterweight 4 comprises a frame 5, which comprises a first upright beam 6 and a second upright beam 7 and a cross beam 8 fixed to the upper ends of the uprights 6, 7 thus connecting them. This is implemented by fixing the cross beam to the upper ends of the uprights 6 and 7. A diverting pulley 9 is mounted rotatably between the guide rails 1, 2 on the cross beam 8 of the counterweight frame 5. The pulley 9 has a vertical plane of rotation 10, which crosses the guide rail plane 3 at an acute angle. The angle between the planes 3 and 10 is preferably between 5 and 20 degrees. In this way, the roping 18 can be guided to and from the counterweight 4 along a vertical plane that is not parallel with the guide rail plane. In this way, the roping can be arranged to leave the counterweight distant from the guide rail plane, yet still maintaining the counterweight suspension at least substantially central. The cross beam 8 is aligned parallel with the plane of rotation 10 of the pulley 9. This means that its longitudinal axis extends parallel with said plane of rotation 10. This construction reduces the twisting of the frame. This twisting would be caused by the suspension via a diverting pulley, having a plane of rotation at an acute angle relative to the guide rail plane. Reduction of the twist has the effect of reducing the amount of wear of the guide means 11 and 12 mounted on the frame 5. Also, the unevenness of the wear can in this way be reduced.

The frame 5 of the counterweight 4 comprises a first upright beam 6 extending vertically adjacent the first guide rail 1, and a second upright beam 7 extending vertically adjacent the second guide rail 2. That is, the first upright beam 6 extends vertically closer to the first than second guide rail and the second upright beam 7 extends vertically closer to the second than the first guide rail. The counterweight 4 comprises a first guide means 11 mounted on the frame 5, and supported laterally against the first guide rail 1, and a second guide means 12 mounted on the frame 5, and supported laterally against the second guide rail 2. Each of the guide means 11, 12 comprises a guide member 11*a*, 12*a* on the first side and a guide member 11*b*, 12*b* the second side of the guide rail plane and the guide rails comprise a guide flange extending between said members 11*a*,11*b*;12*a*,12*b*. The first guide means 11 is mounted on the first upright 6 and the second guide means 12 is mounted on the second upright 7. The counterweight frame 5 further comprises a second cross beam 16 fixed to the lower ends of the uprights 6, 7 thus connecting the lower ends of the uprights 6, 7. This second cross beam 16 is preferably also oriented parallel with the plane of rotation 10 of the pulley 9. In the preferred embodiment, the cross beams 8, 16 and the uprights 6,7 together form a ring-shaped frame 5. The guide means 11 and 12 are in the preferred embodiment mounted on the upright beams 6,7 via fixtures 21,22. The guide members 11*a*,11*b*;12*a*,12*b* are in the illustrated embodiment guide sliders, but alternatively they could be in the form of guide rollers.

The weight of the counterweight 4 is preferably adjusted suitable with additional weight elements 15. In the preferred embodiment, the counterweight 4 further comprises weight elements 15 mounted on the frame 5. The counterweight weight elements 15 are placed inside the ring-shaped frame 5 formed by the cross beams 8, 16 and the uprights 6,7.

The cross beam 8 is preferably of such construction that it comprises a vertically planar first plate 13 and a vertically planar second plate 14 as illustrated in Figures. The plates are parallel with the plane of rotation 10 of the pulley 9 and displaced from each other in the direction of the rotational axis of the pulley 9, and the diverting pulley 9 is placed between the plates 13, 14. In this way, a space for accommodating the pulley can be provided inside the cross beam, thereby making the structure space efficient. The box-type structure facilitates the rigidity of the structure. In the illustrated embodiment, the upper edges of the side plates 13, 14 are connected by the uprights but also with a plate structure. The additional plate connection is not necessary, however. On the other hand the side plates could be formed to be integral with each other. The cross beam 8 could then be in the form of a tubular metal beam for instance. In the preferred embodiment, the pulley 9 is mounted on the cross beam as follows. The pulley comprises a shaft which is supported on the first side of the pulley 9 by the first side plate 13 and on the second side by the second side plate 14. This supporting is implemented such that each of the plates 13, 14 comprises a slot 19 which opens downwards and the ends of the shaft are placed in the slots. The shaft can thus be installed from below the cross beam 8. This structure makes the engagement of the pulley shaft reliable, because the weight of the counterweight 4 prevents the shaft ends from escaping away from the slots 19. The pulley 9 could alternatively be supported on the cross beam in any known way. Preferably, also the second cross beam 16 is of such construction that it comprises a vertically planar first plate and a vertically planar second plate correspondingly as the cross beam 8. The plates of the second cross beam 16 are also parallel with the plane of rotation 10 of the pulley 9 and displaced from each other in the direction of the rotational axis of the pulley 9.

In the preferred embodiment, the uprights are vertically oriented u-profile beams their open sides (i.e. the channel-sides) facing towards each other. The uprights 6, 7 have similar profiles. Each of them has a planar bottom section the plane of which is orthogonal to the plane of rotation. The cross beam 8 is fixed on the inner surface of both of the u-profile upright beams. Each of the upright beams 6, 7 has edge sections extending parallel to the plane of rotation forming sides of the u-profile. The first end of the cross beam 8 extends further on the first side of the guide rail plane 10 and the second end of the cross beam 8 extends further on the second side B of the guide rail plane 10. The center line x1 of the first upright 6 and the center line x2 of the second upright 7 are preferably displaced from each other towards opposite axial directions of the pulley. The first upright beam 6 fixed on the first end of the cross beam 8 is displaced towards the second side B and the second upright 7 fixed on the second end being displaced towards the first side A of the guide rail plane 10. Thus, the cross beam 8 and the upright beams 6,7 together form a shape of letter Z when viewed vertically. In this way, the guide means can be mounted on the uprights on the guide rail line even though the ends of the diagonally placed cross beam are not on the guide rail plane. This also makes the frame more symmetrical relative to the guide rail plane in a space efficient manner, thus reducing the twist and uneven wear of the guide elements. This displacement is not necessary though. This is because the uprights can be made so large that guide means can be mounted without problems. The upright beams are furthermore preferably placed such that the center line x1 of the first upright 6 extends vertically on the first side A of the guide rail plane 3, and the center line x2 of the second upright 7 extends vertically on the second side (B) of the guide rail plane 10, centerline here meaning the vertical line passing via the center of cross sectional area of the beam profile.

The weight elements 15 are between the guide rails, each weight elements having opposite side faces parallel with the guide rail plane and/or the weight elements form together a stack of weight elements with opposite side faces parallel with the guide rail plane. The weight elements 15 each have a first distal end form-locked in channel of the first upright and a second distal end form-locked in the channel of the second upright.

Figure 4:
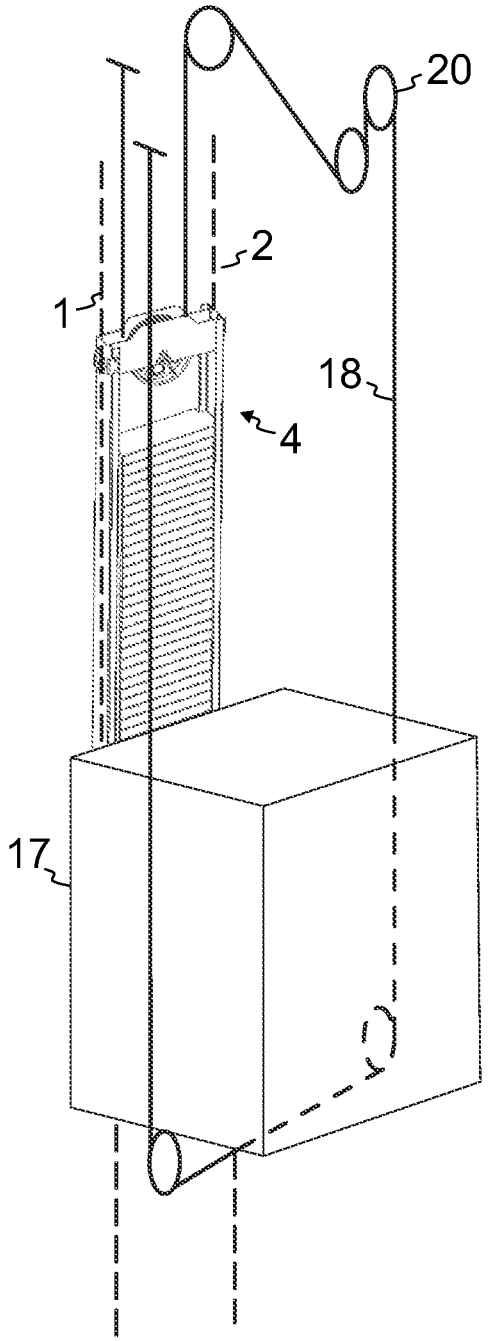
FIG. 4 illustrates an elevator according to a preferred embodiment.

FIG. 4 illustrates an embodiment of an elevator comprising the counterweight arrangement as above described and a roping 18 suspending the counterweight 4 and the elevator car 17. The roping suspends the counterweight via a pulley around which it passes. The elevator further comprises a drive machine (not shown) which drives the elevator car 17 and counterweight 4 under control of an elevator control system (not shown). The drive machine preferably comprises a motor and a traction sheave 20 formed by one of the pulleys over which the roping 18 passes. The drive sheave 20 engages elevator roping 18, which roping 18 is connected to the elevator car 17 and the counterweight 4. Thus, driving force can be transmitted from the motor to the car 17 via the traction sheave 20 and the roping 18. In the preferred embodiment the counterweight is on the back-side of the car 17 the guide rail plane, which in this case is parallel to the back wall of the car 17. On side the opposite to the counterweight 4, i.e. on the front side, the car 17 preferably comprises a door (not showed). The roping 18 passes from its fixing point down to the pulley 9 mounted on the counterweight 4 in the manner as earlier described, and turns around this pulley 9, passes upwards, and is guided to pass around a drive sheave 20 which is located at the side of the car path and has a rotational plane orthogonal to the guide rail plane. The roping leaves the drive sheave 20 and passes around pulleys 23 mounted on the car 17. These pulleys 23 guide the roping 18 to pass across the vertical projection of the car in width direction of the car, the width direction being orthogonal to the front-back-direction.

In the preferred embodiment, each upright beam 6, 7 is an integral one-piece structure. However, each of these beams could be alternatively formed non-integrally, e.g. by forming each beam of two or more structures fixed to each other as it is the case with the cross beam 8 in the preferred embodiment. Respectively, the cross beam 8 could be alternatively formed to be an integral one piece structure. In that case the side plates would be integral parts of a one-piece structure. The upright beams 6,7 and the cross beam(s) 8 (and 16) are preferably made of metal. The upright beams 6,7 and the cross beam(s) 8 (and 16) are preferably all elongated, the upright beams in vertical direction and the cross beam in horizontal direction. In the preferred embodiment there are several weight elements stacked on top of each other. However, alternatively instead of the plural small weight elements 15 there could be only one larger weight element. In that case, the shape of this single weight element would preferably be similar to the shape of the stack of weight elements 15 as illustrated.

It is to be understood that the above description and the accompanying Figures are only intended to illustrate the present invention. It will be apparent to a person skilled in the art that the inventive concept can be implemented in various ways. The elevator arrangement as described above can be used to solve problems or drawbacks in various elevators, not only in the elevators of the type illustrated in FIG. 4. The invention and its embodiments are not limited to the examples described above but may vary within the scope of the claims.

The invention claimed is:

1. A counterweight arrangement for an elevator, comprising:

a first vertical guide rail and a second vertical guide rail, said guide rails defining a vertical guide rail plane;

a counterweight arranged to travel between the guide rails guided by the guide rails, the counterweight comprising a frame, which comprises a first upright beam and a second upright beam and a cross beam connecting upper ends of the first and second upright beams; and a diverting pulley mounted between the guide rails on the cross beam of the counterweight frame, the diverting pulley having a vertical plane of rotation, which crosses the vertical guide rail plane, wherein the cross beam is aligned parallel with the vertical plane of rotation of the pulley.

2. The counterweight arrangement for an elevator according to claim 1, wherein the counterweight comprises a first guide mounted on the frame, and supported laterally against the first vertical guide rail, and a second guide mounted on the frame, and supported laterally against the second vertical guide rail.

3. The counterweight arrangement for an elevator according to claim 2, wherein each guide comprises a guide member on both the first side and the second side of the guide rail plane, and the first vertical guide rail comprises a guide flange extending between guide members of the first guide and the second guide rail comprises a guide flange extending between guide members of the second guide.

4. The counterweight arrangement for an elevator according to claim 2, wherein the first guide is mounted on the first upright beam and the second guide is mounted on the second upright beam.

5. RAH The counterweight arrangement for an elevator according to claim 2, wherein each guide comprises a guide member on both a first side and a second side of the guide rail plane, and the first guide rail comprises a guide flange extending between guide members of the first guide and the second guide rail comprises a guide flange extending between a guide members of the second guide.

6. The counterweight arrangement for an elevator according to claim 2, wherein the first guide is mounted on the first upright beam and the second guide is mounted on the second upright beam.

7. The counterweight arrangement for an elevator according to claim 1, wherein the first upright beam extends vertically adjacent the first guide rail, and the second upright beam extends vertically adjacent the second guide rail.

8. The counterweight arrangement for an elevator according to claim 7, wherein the counterweight comprises a first guide a mounted on the frame, and supported laterally against the first guide rail, and a second guide mounted on the frame, and supported laterally against the second guide rail.

9. The counterweight arrangement for an elevator according to claim 8, wherein each guide comprises a guide member on both a first side and a second side of the guide rail plane, and the first guide rail comprises a guide flange extending between guide members of the first guide and the second guide rail comprises a guide flange extending between guide members of the second guide.

10. The counterweight arrangement for an elevator according to claim 8, wherein the first guide is mounted on the first upright beam and the second guide is mounted on the second upright beam.

11. The counterweight arrangement for an elevator according to claim 1, wherein the cross beam is fixed to the upper ends of the first and second upright beams.

12. The counterweight arrangement for an elevator according to claim 1, wherein the cross beam comprises a vertically planar first side plate and a vertically planar second side plate, the side plates being parallel with the plane of rotation of the pulley and displaced from each other in a direction of the rotational axis of the pulley.

13. The counterweight arrangement for an elevator according to claim 1, wherein the side plates and are fixed to the upper ends of the first and second upright beams.

14. The counterweight arrangement for an elevator according to claim 1, wherein the diverting pulley is placed between the side plates.

15. The counterweight arrangement for an elevator according to claim 1, wherein the first and second upright beams are vertically oriented u-profile beams.

16. The counterweight arrangement for an elevator according to claim 1, wherein the counterweight further comprises one or more weight elements mounted on the frame.

17. The counterweight arrangement for an elevator according to claim 1, further comprising a plurality of the weight element forming a stack of weight elements, each weight element having planar opposite side faces, which are parallel with the guide rail plane.

18. The counterweight arrangement for an elevator according to claim 1, wherein the counterweight further comprises a second cross beam connecting the lower ends of the first and second upright beams, the second cross beam being aligned parallel with the plane of rotation of the pulley.

19. The counterweight arrangement for an elevator according to claim 1, wherein a center line of the first upright beam extends vertically on the first side of the guide rail plane, and a center line of the second upright beam extends vertically on the second side of the guide rail plane.

20. An elevator, comprising:

an elevator car;

a counterweight arrangement; and a roping suspending the counterweight and the elevator car, and passing around a diverting pulley mounted on the counterweight, wherein the counterweight arrangement is as defined in claim 1.

* * * * *